US008650714B2

(12) United States Patent
Staude

(10) Patent No.: US 8,650,714 B2
(45) Date of Patent: Feb. 18, 2014

(54) HINGE FOR CONNECTING A LEAF TO A FRAME SO AS TO BE HINGED ABOUT A HINGE AXIS

(75) Inventor: Wolfgang Staude, Waldeck (DE)

(73) Assignees: Dr. Hahn GmbH & Co. KG, Moenchengladbach-Wickrath (DE); Staude Kunststofftechnik GmbH, Waldeck (DE)

( * ) Notice: Subject to any disclaimer, the term of this patent is extended or adjusted under 35 U.S.C. 154(b) by 168 days.

(21) Appl. No.: 13/375,487

(22) PCT Filed: May 27, 2010

(86) PCT No.: PCT/EP2010/057337

§ 371 (c)(1), (2), (4) Date: Dec. 1, 2011

(87) PCT Pub. No.: WO2010/139604

PCT Pub. Date: Dec. 9, 2010

(65) Prior Publication Data

US 2012/0073083 A1 Mar. 29, 2012

(30) Foreign Application Priority Data

Jun. 4, 2009 (DE) ..... 10 2009 025 916

(51) Int. Cl.
*E05D 5/10* (2006.01)

(52) U.S. Cl.
USPC ..... 16/386; 16/385; 439/31; 439/165

(58) Field of Classification Search
USPC ..... 16/385–386, 223, 273, DIG. 14; 439/31, 439/165; 307/104; 200/61.7
See application file for complete search history.

(56) References Cited

U.S. PATENT DOCUMENTS

| | | | | | |
|---|---|---|---|---|---|
| 1,744,040 | A * | 1/1930 | Elzer | 439/31 |
| 3,838,234 | A * | 9/1974 | Peterson | 200/61.7 |
| 3,842,386 | A * | 10/1974 | Suska | 439/31 |
| 3,857,625 | A * | 12/1974 | Crane et al. | 439/31 |
| 4,412,711 | A * | 11/1983 | Suska | 439/31 |
| 4,839,939 | A * | 6/1989 | O'Brien, II | 16/223 |
| 5,586,895 | A * | 12/1996 | Zehrung | 439/165 |
| 5,727,960 | A * | 3/1998 | Zehrung | 439/165 |
| 6,409,517 | B2 * | 6/2002 | Malnati | 439/38 |
| 7,824,200 | B2 * | 11/2010 | Bryla et al. | 439/165 |
| 2012/0017396 | A1 | 1/2012 | Meyer | |

(Continued)

FOREIGN PATENT DOCUMENTS

| | | | |
|---|---|---|---|
| DE | 10 2004 017341 | A1 | 1/2005 |
| WO | WO 2010/049292 | A1 | 5/2010 |

*Primary Examiner* — William Miller
(74) *Attorney, Agent, or Firm* — Norman B. Thot

(57) ABSTRACT

A hinge plate includes a frame hinge plate part comprising a frame fastening part and a frame hinge part. A leaf/sash hinge plate part comprises a leaf/sash fastening part and a leaf/sash hinge part. A primary coil is disposed in the frame hinge part and a secondary coil is disposed in the leaf/sash hinge part, each coil being configured to surround a hinge plate pin. The primary coil extends at least almost up to an end face of the frame hinge part facing the leaf/sash hinge part. The secondary coil extends at least almost up to an end face of the leaf/sash hinge part facing the frame hinge part. A hinge plate pin sleeve comprising a ferrite material is disposed between the hinge plate pin and the primary and secondary coils, and extends approximately over a length of the hinge plate pin surrounded by the primary and secondary coils.

21 Claims, 3 Drawing Sheets

(56) References Cited

U.S. PATENT DOCUMENTS

2012/0066864 A1* 3/2012 Boegel-Poetter et al. ..... 16/273
2012/0242165 A1* 9/2012 Herglotz et al. ..... 307/104
2012/0242166 A1* 9/2012 Herglotz et al. ..... 307/104

* cited by examiner

HINGE FOR CONNECTING A LEAF TO A FRAME SO AS TO BE HINGED ABOUT A HINGE AXIS

CROSS REFERENCE TO PRIOR APPLICATIONS

This application is a U.S. National Phase application under 35 U.S.C. §371 of International Application No. PCT/EP2010/057337, filed on May 27, 2010 and which claims benefit to German Patent Application No. 10 2009 025 916.3, filed on Jun. 4, 2009. The International Application was published in German on Dec. 9, 2010 as WO 2010/139604 A1 under PCT Article 21(2).

FIELD

The present invention provides a hinge plate for connecting a leaf of a door or a sash of a window or the like to a frame so as to be hinged about a hinge axis, with a frame hinge plate part, which can be fastened to the frame and comprises a frame fastening part and a frame hinge part, with a leaf or sash hinge plate part, which can be fastened to the leaf or sash and comprises a leaf or sash fastening part and a leaf or sash hinge part, and with a hinge plate pin, which defines the hinge axis, wherein a primary coil surrounding the hinge plate pin is disposed in the frame hinge part, and wherein a secondary coil surrounding the hinge plate pin is disposed in the leaf or sash hinge part.

BACKGROUND

Doors increasingly have devices which are operated by means of electrical energy for improving safety or convenience.

To supply them with energy, these devices are either galvanically connected, for example, by way of sliding contacts or by way of flexible cables, to an external energy source, or they have energy stores themselves, for example, to rechargeable cells or batteries.

The first-mentioned case has the disadvantage that sliding contacts are susceptible to faults and cable connections significantly impair visual appearance. In the second case, the necessity for separate stores increases operating costs. The space required by the stores also impairs functionality and visual appearance.

DE 10 2004 017 341 A1 describes a hinge plate with a built-in transformer for contactless energy transmission. This hinge plate comprises a primary coil disposed in a frame hinge plate part and a secondary coil disposed in a leaf or sash hinge plate part. A hinge plate pin passing through the two coils serves to magnetically couple the secondary coil to the primary coil, which are spaced apart from each other in the direction of the hinge axis.

Although the contactless energy transmission from a fixed frame into a leaf or sash disposed pivotably on the frame is in principle desirable to avoid the aforementioned disadvantages, tests have shown that, with the hinge plate described in DE 10 2004 017 341 A1, only very small levels of electrical power can be transmitted from the primary side to the secondary side since the power loss in the transmission is very high.

SUMMARY

An aspect of the present invention is to provide a hinge plate which allows for the contactless transmission of higher levels of electrical power.

In an embodiment, the present invention provides a hinge plate for connecting a leaf of a door or a sash of a window or the like to a frame so as to be hinged about a hinge axis which includes a frame hinge plate part comprising a frame fastening part and a frame hinge part. The frame hinge plate part is configured to be fastened to the frame. A leaf or sash hinge plate part comprises a leaf or sash fastening part and a leaf or sash hinge part. The leaf or sash hinge plate part is configured to be fastened to the leaf or to the sash. A primary coil is disposed in the frame hinge part and a secondary coil is disposed in the leaf or sash hinge part. The primary coil and the secondary coil are each configured to surround a hinge plate pin defining the hinge axis. The primary coil extends at least almost up to an end face of the frame hinge part facing the leaf or sash hinge part. The secondary coil extends at least almost up to an end face of the leaf or sash hinge part facing the frame hinge part. A hinge plate pin sleeve comprises a ferrite material. The hinge plate pin sleeve is disposed between the hinge plate pin and the primary coil and the secondary coil. The hinge plate pin sleeve extends approximately over a length of the hinge plate pin surrounded by the primary coil and the secondary coil.

BRIEF DESCRIPTION OF THE DRAWINGS

The present invention is described in greater detail below on the basis of embodiments and of the drawings in which.

DETAILED DESCRIPTION

Figure 1:
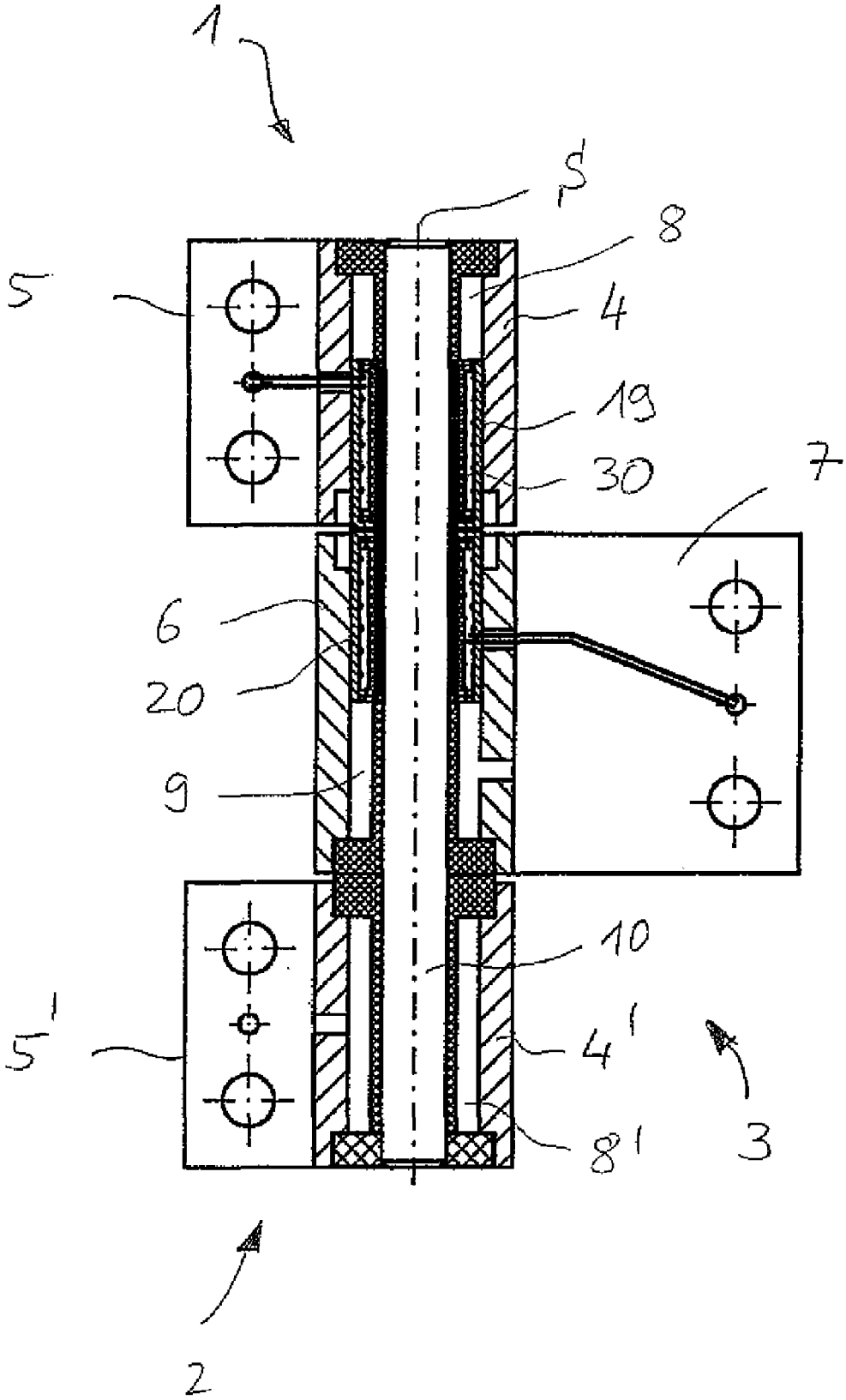
FIG. 1 shows a longitudinal section along the hinge axis.

In the present invention, the fact that the primary coil extends at least almost up to the end face of the frame hinge part that is facing the leaf or sash hinge part, that the secondary coil extends at least almost up to the end face of the leaf or sash hinge part that is facing the frame hinge part, and that a hinge plate pin sleeve which extends approximately over the length of the hinge plate pin and is surrounded by the primary and secondary coils is provided between the hinge plate pin and the coils, surprisingly allows power loss to be quite considerably reduced, so that higher levels of electrical power can be transmitted in comparison with the previously known hinge plate. In addition, the hinge plate according to the present invention has the advantage that any desired materials which have the mechanical properties required for the respective application can be used for the hinge plate pin, since the magnetic coupling takes place by way of the hinge plate pin sleeve and, consequently, the hinge plate pin is primarily of mechanical significance. In order to keep the power loss as low as possible, a distance that is as small as possible is, on the one hand, required between the mutually facing end faces of the primary and secondary coils, on the other hand, the hinge plate pin sleeve should extend as far as possible over the length of the hinge plate pin that is surrounded by the primary and secondary coils, however, it should not exceed this length to the extent possible. In other words, the hinge plate pin sleeve should not protrude from the end faces of the primary and secondary coils that are facing away from each other, or only insignificantly.

In an embodiment of the present invention, the hinge plate pin sleeve can, for example, comprise a ferrite sleeve, which may be produced from a sintered material. Such ferritic material is well suited for bringing about the best possible coupling of the secondary coil to the primary coil.

In order that the smallest possible mechanical forces, and at best almost no mechanical forces, act on the hinge plate pin sleeve when the leaf or sash hinge plate part and the frame hinge plate part are pivoted with respect to one another about the hinge axis during the opening or closing of the leaf or sash, the hinge plate pin sleeve can, for example, comprise an inner sliding layer, which forms the inner lateral surface thereof and with which it lies against the hinge plate pin at least substantially free from play. Because of this, the hinge plate pin sleeve and the hinge plate pin can turn in relation to each other about the hinge axis practically friction-free. On account of the almost complete freedom from play, the overall diameter of the hinge plate pin sleeve can be minimized, so that the space requirement needed for it can likewise be minimized.

In an embodiment of the present invention, the inner sliding layer can, for example, be formed by an inner hinge plate pin sliding sleeve which comprises a plastics material having sliding properties. This material constitutes, for example, plastics based on POM (polyoxymethylene or polyacetal) sliding-bearing-modified, for example, by additions of PTFE or chalk, which can also be worked into sleeves with very small wall thicknesses to less than one tenth of a millimeter.

In order to still further improve the magnetic coupling of the secondary coil to the primary coil, the plastics material may comprise particles of ferromagnetic material. Tests have shown that up to 50% by volume of ferrite particles with a maximum grain size of 500 μm (screened) can be admixed with a POM-based plastics material, as long as the maximum grain size is less than the wall thickness of the hinge plate pin sliding sleeve. The proportion of the ferrite particles can, for example, be approximately 25% by volume or less in the case of a maximum grain size of 10 μm, since the sliding properties of this plastics material then do not worsen in a way that is unacceptable for this application even with small wall thicknesses of the hinge plate pin sliding sleeve.

In an embodiment of the present invention, the hinge plate pin sleeve can, for example, comprise an outer sliding layer, which forms the outer lateral surface thereof, so as reduce the risk that forces are transmitted to the coil when the frame hinge plate part and the leaf or sash hinge plate part are pivoted about the hinge axis.

The outer sliding layer may, for example, be formed by an outer hinge plate pin sliding sleeve which comprises a plastics material having sliding properties, for example, based on POM.

As in the case of the inner hinge plate pin sliding sleeve, particles of ferritic material may also be admixed with the plastics material in the aforementioned proportion and with the aforementioned grain size so as to further improve the magnetic coupling of the secondary coil to the primary coil.

The above-described structure of the hinge plate pin sleeve with an inner hinge plate pin sliding sleeve, ferrite sleeve and outer hinge plate pin sliding sleeve, wherein the hinge plate pin sliding sleeves contain ferrite particles, leads to a particularly low power loss of the hinge plate according to the present invention. It may, however, be sufficient for the magnetic coupling to produce the hinge plate pin sleeve only from a plastics material described above with an appropriate proportion of ferrite, in particular whenever only relatively low levels of electrical power are intended to be transmitted.

In an embodiment of the hinge plate of the present invention, at least one of the coils, for example, both the primary coil and the secondary coil, has/have a sleeve-shaped ferrite core, which can, for example, be made of a sintered material. This ferrite core may have on both its extreme ends formed-on, radially protruding collars, between which the coil winding can, for example, extend. The two collars on the one hand reliably prevent the coil windings from being able to rub against one another when there is a relative movement of the primary coil and the secondary coil, which would lead to almost immediate destruction of the coils, on the other hand the magnetic coupling of the two coils by way of their mutually facing end faces is improved by these collars.

In order to further increase the certainty that no torques are introduced into the coils when there is a relative movement of the frame hinge plate part and the leaf or sash hinge plate part in relation to each other about the hinge axis, at least one of the coils, for example, both the primary coil and secondary coil, has/have inner sliding coil sleeves, the inside diameter of which is adapted to the outside diameter of the outer hinge plate pin sliding sleeve, so that the sliding sleeves interact at least substantially free from play.

In an embodiment of the present invention, at least one of the coils, for example, both the primary coil and the secondary coil, has/have outer coil sleeves, which form the outer lateral surfaces of the coil and the outside diameter of which is adapted to the inside diameter of a hinge plate pin receptacle provided in the frame hinge part and/or in the leaf or sash hinge part, in the sense of a snug fit not allowing any relative movement between the coil and the frame hinge part or the leaf or sash hinge part. This measure reliably avoids the tearing off of electrical connections led out from the coils being caused by turning of the coil in relation to the frame hinge part or the leaf or sash hinge part.

In a way analogous to the hinge plate pin sliding sleeves, the inner sliding coil sleeve and the outer coil sleeve may also be produced from plastics material, for example, containing ferromagnetic particles, in the case of the inner sliding coil sleeve, for example, with sliding properties.

It has surprisingly been found that an electrical power sufficient for many applications can be transmitted with the aid of the hinge plate according to the present invention if the coil has a singly wound, for example, at least a two-layered coil winding of a copper material with a coil wire diameter of between 0.03 and 0.1 mm, for example, between 0.05 and 0.07 mm in diameter. The coil is then distinguished by only a small thickness (thickness means here the distance between the inner lateral surface and the outer lateral surface of the coil), so that its space requirement is low. In many cases, hinge plates according to the present invention can therefore be produced with an outer appearance which corresponds to already existing, purely mechanically acting hinge plates. Hinge plates according to the present invention can thus be introduced into already existing ranges of hinge plates. It is often not possible to see from the outside of a hinge plate according to the present invention the dual function thereof (the transmission of holding forces and of electrical power) which reduces the probability of undesired manipulation by third parties.

The hinge plate denoted as a whole in the drawing by 100 is formed as a so-called three-part hinge plate. It comprises an upper frame hinge plate part 1 and a lower frame hinge plate part 2, which are spaced apart from each other in the longitudinal direction of a hinge axis S.

Disposed between the upper and lower frame hinge plate parts 1, 2 is a leaf or sash hinge plate part 3.

The upper and lower frame hinge plate parts 1, 2 respectively comprise a frame hinge part 4, 4' and a frame fastening part 5, 5'. Accordingly, the leaf or sash hinge plate part comprises a leaf or sash hinge part 6 and a leaf or sash fastening part 7.

The hinge axis S is defined by a hinge plate pin 10 passing through the frame hinge parts 4, 4' and the leaf or sash hinge part 6 in hinge plate pin receptacles 8, 8' and 9. Bearing bushes 11, 11' and 12 of a plastics material, for example based on POM with sliding-bearing-modified additions, which has proven successful for use as a bearing bush for hinge plates, serve for the bearing of the hinge plate pin 10 in the hinge plate pin receptacles 8, 8', 9. The bearing bushes 11, 11', 12 have radial projections 13, extending parallel to the hinge axis S. The diameter of the circle joining the radial projections 13 to one another is adapted to the inside diameter of the hinge plate pin receptacles 8, 8', 9 in such a way that the bearing bushes 11, 11', 12 engage in the respective hinge plate pin receptacle free from play. Formed on at the upwardly directed end of the bearing bush of the lower frame hinge plate part 2, at the upper end of the bearing bush 11 of the upper frame hinge plate part 1 and at the lower end of the bearing bush 12 of the leaf or sash hinge plate part 3 are annular end regions 14, which slightly protrude radially beyond the radial projections 13. They rest in a correspondingly dimensioned radial widening 15 of the respective hinge plate pin receptacle 8, 8', 9 and consequently terminate the hinge plate pin receptacles outwardly against penetration by contaminants. In addition, the end regions 14 of the bearing bushes 11' of the lower frame hinge plate part 2 and of the leaf or sash hinge plate part 3 form rests by way of which forces acting in the direction of the hinge axis are introduced from the leaf or sash hinge plate part 3 into the lower frame hinge plate part 2. Furthermore, the bearing bushes 11, 11', 12 have inner bores 16, the diameter of which is adapted to the diameter of the hinge plate pin 10 in such a way that the latter is accommodated rotatably, but at least substantially free from play, by the bearing bushes 11, 11', 12.

The lower termination of the lower frame hinge plate part 2 is formed by a bearing disk 17, the dimensions of which correspond to the end regions 14 and which is inserted into a radial widening 15 of the lower frame hinge plate part.

Figure 3:
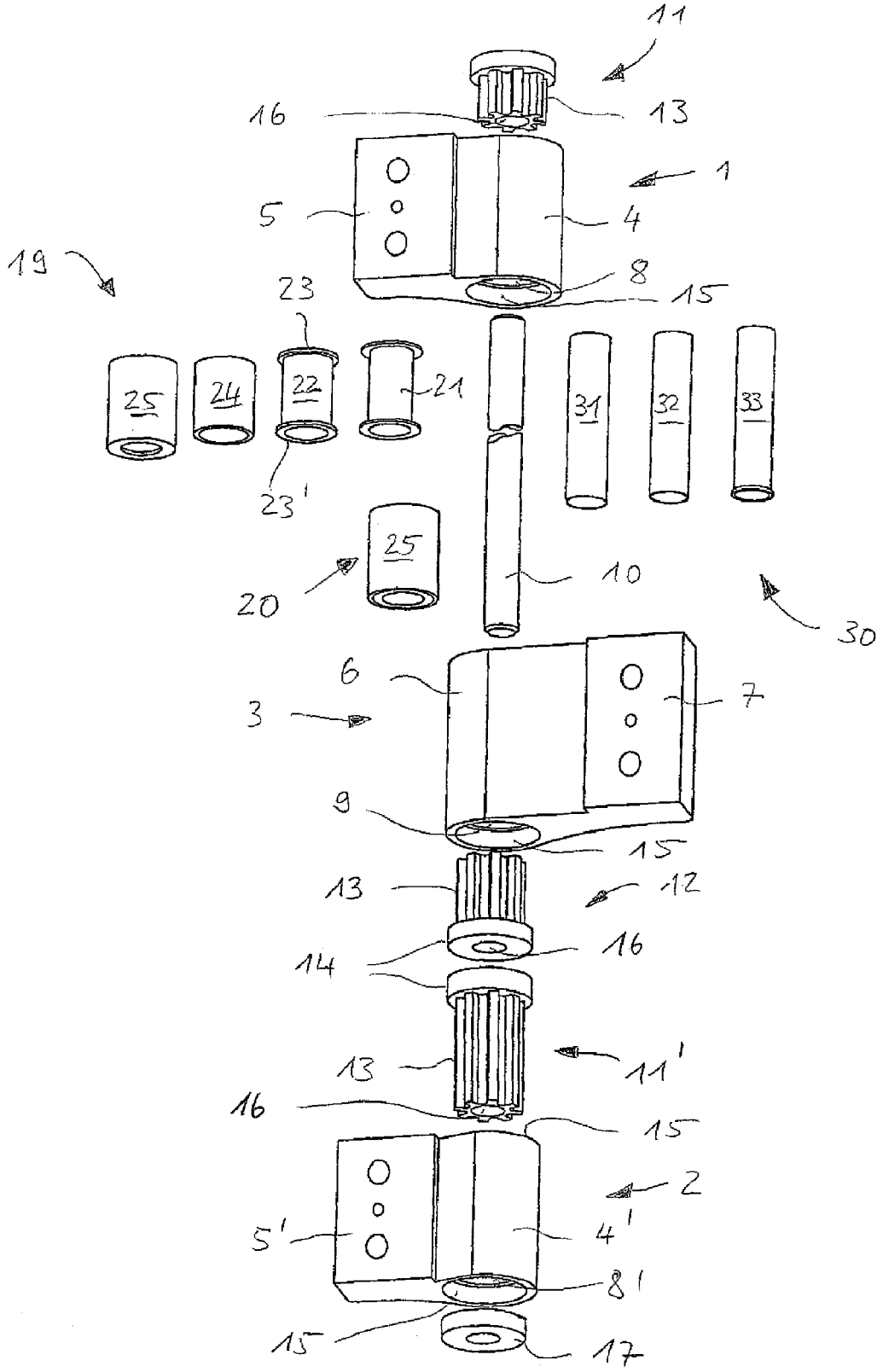
FIG. 3 shows an exploded representation of the same exemplary embodiment as in FIGS. 1 and 2.

As can be seen in particular in FIG. 3, the length of the bearing bush 11' corresponds almost to the length of the hinge plate pin receptacle 8' of the lower frame hinge plate part 2, whereas the bearing bushes 11, 12 are only formed approximately half as long as the hinge plate pin receptacle 8 of the upper frame hinge plate part 1 or the hinge plate pin receptacle 9 of the leaf or sash hinge plate part 3. A primary coil 19 and a secondary coil 20 are fitted in the remaining free space of the hinge plate pin receptacles 8, 9. The primary coil 19, which in FIG. 3 is represented in the form of individual parts arranged next to one another, and the secondary coil 20 both comprise an inner sliding coil sleeve 21 and a sleeve-shaped ferrite core 22, which is located on the sliding coil sleeve 21 and comprises on its extreme ends radially protruding collars 23, 23', a two-layered coil winding 24, which is wound between the collars 23, 23' and is only schematically represented in the drawing, and an outer coil sleeve 25. The outside diameter of the outer coil sleeve 25 is dimensioned such that the primary coil 19 is accommodated in the hinge plate pin receptacle 8 of the upper frame hinge plate part 1 and the secondary coil 20 is accommodated in the hinge plate pin receptacle 9 of the leaf or sash hinge plate part in a rotationally secured snug fit.

Figure 2:
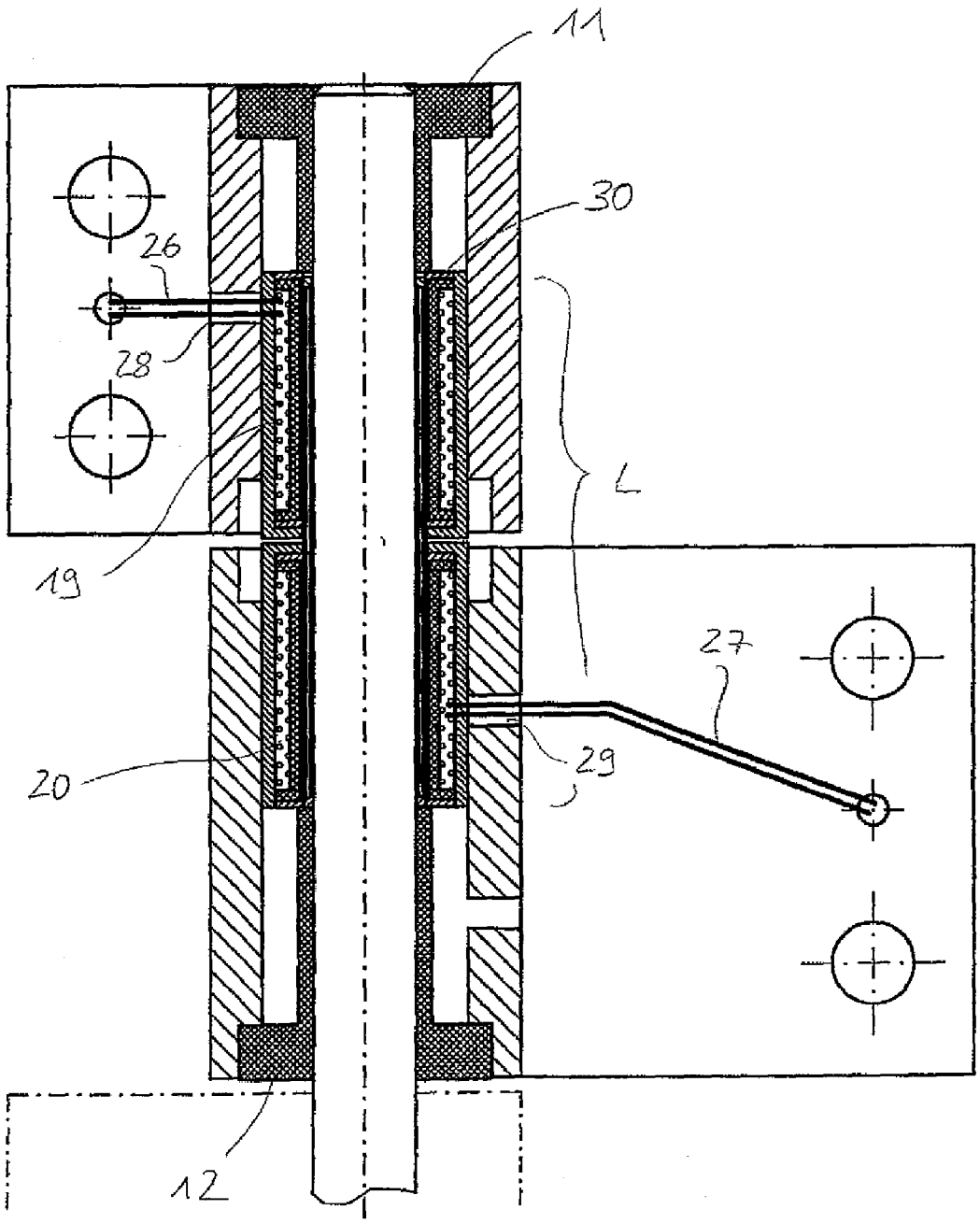
FIG. 2 shows an enlarged representation of the upper frame hinge plate part and the leaf or sash hinge plate part.

As can be seen in particular in FIG. 2, electrical connecting cables 26, 27 are led out through access bores 28, 29 from the primary coil 19 and the secondary coil 20 to the outside for contacting to an electrical power source and to a load.

In order to improve the magnetic coupling of the secondary coil 20 to the primary coil 19, the hinge plate pin 10 is surrounded over the length L that is surrounded by the primary coil 19 and the secondary coil 20 (see FIG. 2) by a hinge plate pin sleeve 30 comprising a ferromagnetic material. As FIG. 3 in particular reveals, the hinge plate pin sleeve 30 comprises an inner hinge plate pin sliding sleeve 31, the inner lateral surface of which has a diameter which is adapted to the outside diameter of the hinge plate pin 10 in such a way that it lies against the hinge plate pin 10 at least substantially free from play, a ferrite sleeve 32, which surrounds the inner hinge plate pin sliding sleeve and is produced from a sintered material, and an outer hinge plate pin sliding sleeve 33, which lies against the outer lateral surface of the ferrite sleeve 32 and the outside diameter of which is adapted to the inside diameter of the sliding coil sleeve 21 in such a way that the outer hinge plate pin sliding sleeve 33 engages in the sliding coil sleeve 21 rotatably, but at least substantially free from play.

In order to improve the magnetic coupling of the secondary coil 20 to the primary coil 19, the inner sliding coil sleeve 21, the outer coil sleeve 25 and the inner and outer hinge plate pin sliding sleeves 31, 33 are produced from a POM-based plastics material which has sliding properties and in which ferritic particles of a grain size of 10 μm (screened) and a proportion by volume of 25 percent are admixed.

The present invention is not limited to embodiments described herein; reference should be had to the appended claims.

LIST OF REFERENCE NUMBERS

100 hinge plate
1 upper frame hinge plate part
2 lower frame hinge plate part
3 leaf or sash hinge plate part
4, 4' frame hinge part
5, 5' frame fastening part
6 leaf or sash hinge part
7 leaf or sash fastening part
8, 8' hinge plate pin receptacle
9 hinge plate pin receptacle
10 hinge plate pin
11, 11' bearing bush
12 bearing bush
13 radial projections
14 end regions
15 radial widening
16 inner bores
17 bearing disk
19 primary coil
20 secondary coil
21 sliding coil sleeve
22 ferrite core
23, 23' collar
24 coil winding
25 outer coil sleeve
26 connecting cable
27 connecting cable
28 access bore
29 access bore
30 hinge plate pin sleeve
31 inner hinge plate pin sliding sleeve
32 ferrite sleeve
33 outer hinge plate pin sliding sleeve
L length
S hinge axis

What is claimed is:

1. A hinge plate for connecting a leaf of a door or a sash of a window to a frame so as to be hinged about a hinge axis, the hinge plate comprising:

a frame hinge plate part comprising a frame fastening part and a frame hinge part, the frame hinge plate part being configured to be fastened to the frame;

a leaf or sash hinge plate part comprising a leaf or sash fastening part and a leaf or sash hinge part, the leaf or sash hinge plate part being configured to be fastened to the leaf or to the sash;

a primary coil disposed in the frame hinge part and a secondary coil disposed in the leaf or sash hinge part, the primary coil and the secondary coil each surrounding a hinge plate pin defining the hinge axis, the primary coil extending at least almost up to an end face of the frame hinge part facing the leaf or sash hinge part, and the secondary coil extending at least almost up to an end face of the leaf or sash hinge part facing the frame hinge part; and a hinge plate pin sleeve comprising a ferrite material, the hinge plate pin sleeve being disposed between the hinge plate pin and the primary coil and the secondary coil, the hinge plate pin sleeve extending approximately over an entire length of the hinge plate pin that is surrounded by the primary coil and the secondary coil.

2. The hinge plate as recited in claim 1, wherein the hinge plate pin sleeve comprises a ferrite sleeve.

3. The hinge plate as recited in claim 2, wherein the ferrite sleeve comprises a sintered material.

4. The hinge plate as recited in claim 1, wherein the hinge plate pin sleeve comprises an inner sliding layer forming an inner lateral surface of the hinge plate pin sleeve, the inner sliding layer the hinge plate pin sleeve lying against the hinge plate pin so as to be substantially free of play.

5. The hinge plate as recited in claim 4, wherein the inner sliding layer is formed by an inner hinge plate pin sliding sleeve comprising a plastics material with a sliding property.

6. The hinge plate as recited in claim 5, wherein the plastics material comprises particles of a ferromagnetic material.

7. The hinge plate as recited in claim 1, wherein the hinge plate pin sleeve comprises an outer sliding layer forming an outer lateral surface of the hinge plate pin sleeve.

8. The hinge plate as recited in claim 7, wherein the outer sliding layer is formed by an outer hinge plate pin sliding sleeve comprising a plastics material with a sliding property.

9. The hinge plate as recited in claim 8, wherein the plastics material comprises particles of a ferromagnetic material.

10. The hinge plate as recited in claim 8, wherein at least one of the primary coil and the secondary coil comprise a ferrite core having a sleeve shape.

11. The hinge plate as recited in claim 10, wherein the ferrite core comprises a sintered material.

12. The hinge plate as recited in claim 10, wherein the ferrite core comprises radially-protruding collars at each respective end of the ferrite core.

13. The hinge plate as recited in claim 12, further comprising a coil winding disposed between the radially-protruding collars of the ferrite core.

14. The hinge plate as recited in claim 10, wherein at least one of the primary coil and the secondary coil comprise an inner sliding coil sleeve forming an inner lateral surface of the ferrite core, an inside diameter of the inner sliding coil sleeve being adapted to an outside diameter of the outer hinge plate pin sliding sleeve so that the inner sliding coil sleeve and the outer hinge plate pin sliding sleeve interact at least substantially free of play.

15. The hinge plate as recited in claim 14, wherein the inner sliding coil sleeve comprises a plastics material.

16. The hinge plate as recited in claim 1, further comprising a hinge plate pin receptacle disposed in the frame hinge part or in the leaf or sash hinge part, and where at least one of the primary coil and the secondary coil comprise an outer coil sleeve forming an outer lateral surface of the respective primary coil and secondary coil, wherein an outside diameter of the outer coil sleeve is adapted to an inside diameter of the hinge plate pin receptacle so to prevent a relative movement between the primary coil and the secondary coil and the frame hinge part or the leaf or sash hinge part.

17. The hinge plate as recited in claim 16, wherein the outer coil sleeve comprises a plastics material.

18. The hinge plate as recited in claim 17, wherein the plastics material comprises particles of a ferromagnetic material having a sliding property.

19. The hinge plate as recited in claim 18, wherein at least one of the primary coil and the secondary coil has at least a singly wound coil winding comprising copper with a coil wire diameter of between 0.03 and 0.1 mm.

20. The hinge plate as recited in claim 19, wherein the coil wire diameter is between 0.05 and 0.07 mm.

21. The hinge plate as recited in claim 19, wherein at least one of the primary coil and the secondary coil has at least two wound coil windings.

* * * * *